US010625401B1

(12) United States Patent
Kobos

(10) Patent No.: US 10,625,401 B1
(45) Date of Patent: Apr. 21, 2020

(54) MULTIFUNCTION CLAMP AND JACK SYSTEM WITH ATTACHMENTS FOR VARIOUSLY SHAPED WORKPIECES

(71) Applicant: Gery Kobos, Houston, TX (US)

(72) Inventor: Gery Kobos, Houston, TX (US)

( * ) Notice: Subject to any disclaimer, the term of this patent is extended or adjusted under 35 U.S.C. 154(b) by 223 days.

(21) Appl. No.: 15/914,961

(22) Filed: Mar. 7, 2018

(51) Int. Cl.

| | |
|---|---|
| ***B25B 1/20*** | (2006.01) |
| ***B25B 5/10*** | (2006.01) |
| ***B25B 5/16*** | (2006.01) |
| *B25B 5/00* | (2006.01) |

(52) U.S. Cl.
CPC ..... *B25B 5/101* (2013.01); *B25B 5/163* (2013.01); *B25B 5/006* (2013.01)

(58) Field of Classification Search
CPC ..... B25B 5/00; B25B 5/067; B25B 5/082; B25B 5/101
See application file for complete search history.

(56) References Cited

U.S. PATENT DOCUMENTS

| | | | | |
|---|---|---|---|---|
| 2,636,528 A * | 4/1953 | Golnick | B25B 1/125 | 269/182 |
| 4,363,475 A | 12/1982 | McCarty | | |
| 5,893,553 A * | 4/1999 | Pinkous | B25B 5/101 | 269/143 |
| 7,114,714 B2 | 10/2006 | Wong | | |
| 8,807,549 B2 * | 8/2014 | Henze | B25B 5/006 | 269/149 |
| 9,308,626 B2 | 4/2016 | Chuang | | |
| 9,434,053 B2 * | 9/2016 | Selkowitz | B25B 5/101 | |
| 2007/0262506 A1 * | 11/2007 | Alberti | B25B 5/067 | 269/249 |
| 2013/0140750 A1 * | 6/2013 | Allred, III | B25B 5/067 | 269/249 |
| 2016/0023330 A1 * | 1/2016 | Chuang | B25B 5/101 | 269/246 |

* cited by examiner

*Primary Examiner* — Lee D Wilson
(74) *Attorney, Agent, or Firm* — Kenneth A. Roddy

(57) ABSTRACT

A multifunction clamp and jack system having a generally C-shaped main body with an elongate threaded rod with a top end configured to receive an open end wrench, a socket of a socket or ratchet wrench, a male square drive member of a ratchet wrench or a non-ratcheting breaker bar, the drive member of an electric or air impact wrench or a removable handle member, the bottom end of the threaded rod configured to receive selected workpiece engaging rotary attachments, the male square drive member of a ratchet wrench or electric or air impact wrench. The main body may be supported in an upright vertical position by front and rear base support members allowing it to be free standing. A plurality of interchangeable workpiece engaging attachments are provided for clamping, holding, or lifting variously shaped workpieces or objects.

7 Claims, 3 Drawing Sheets

MULTIFUNCTION CLAMP AND JACK SYSTEM WITH ATTACHMENTS FOR VARIOUSLY SHAPED WORKPIECES

BACKGROUND OF THE INVENTION

1. Field of the Invention

This invention relates generally to clamping and jacking apparatus and, more particularly, to a multifunction clamp and jack system having a generally C-shaped main body with an elongate threaded rod having a top end and bottom end configured to receive sockets and drive members of various types of wrenches and selected workpiece engaging attachments, and the bottom end of the main body is configured to receive selected workpiece engaging attachments for clamping, holding, or lifting a wide variety of variously shaped workpieces or objects.

2. Background Art

C-clamps are commonly used in industry to secure a work piece or to secure several work pieces together. A conventional C-clamp typically includes a C-shaped member constructed from cast iron or other hard metal alloy material. One end of the C-shaped member has a threaded hole or collar thereon and a threaded rod threadedly mounted therein and the opposed end of the C-clamp typically has a fixed jaw with a flat surface. The threaded rod has a handle or lever at a top end for rotating the rod and the opposed end the threaded rod has a movable jaw with an opposed flat surface connected to the end of the rod by a ball and socket connection which allows it to rotate and pivot relative to the rod axis. The forward motion of the threaded rod is governed by the thread-by-thread screwing mechanism and is typically slow and time consuming. The workpiece is clamped between the fixed jaw and the movable jaw. This squeezing or clamping action prevents movement of the work piece or prevents movement of several work pieces relative to one another. However, the flat surface of the fixed jaw and the pivoting action and flat surface of the movable jaw makes it very difficult to grip irregular shaped workpieces.

Another common problem with conventional C-clamps is that the operation requires two hands. One hand holds the C-clamp assembly while the other hand manually turns the lever mounted to the outer end of the rod. The lever provides some amount of mechanical advantage and torque for screwing the rod through the threaded hole or collar at the end of the C-clamp to grip the workpiece. However, in some instances, manually turning the lever does not provide the necessary torque required to securely squeeze or clamp the work piece between the flat ends of the fixed and movable jaws.

There are several patents that are directed toward various clamp devices that attempt to overcome one or more of these problems. The following are several examples.

McCarty, U.S. Pat. No. 4,363,475 discloses a vise-like C-clamp for gripping variously shaped work pieces in varying positions. The apparatus includes a vise-like C-clamp with adjusting screw wherein two elongated square bars are fixedly attached to one jaw thereof and the clamping end of the adjusting screw whereby a pair of gripping heads may be selected from a group of variously shaped heads and oppositely and interchangeably arranged on each of the bars. The clamp may be hand held or adjustably mounted in a supporting base for gripping and positioning variously shaped work pieces in horizontal, vertical, and angularly held positions while work is performed thereon.

Wong, U.S. Pat. No. 7,114,714, discloses a multi-function clamping system composed of a few interacting and interoperative clamping components. It is based around a J-bar to which other clamping components such as X-axis, Y-axis, extender blocks, L-links, bench rests, joint V-blocks, and V-pad clamping components can be threadedly or slidably assembled into a wide variety of configurations, and may be configured for expansive or compressive clamping.

Chuang, U.S. Pat. No. 9,308,626, discloses a clamp with ratchet device for clamping a target object which includes a clamp body, a thread rod, a clamping member, and a ratchet device. The clamp body has a fixed part and an installation part. The thread rod is movably disposed on the installation part and has a first end and a second end. The clamping member is disposed on the second end of the thread rod. The ratchet device is combined to a first end of the thread rod and operated between an idling position and a driving position. The ratchet device is able to drive the thread rod to rotate and move toward and away from the fixed part at the driving position, and idle against the thread rod at the idling position. Thus, the clamp may be operated in a narrow space.

SUMMARY OF THE INVENTION

The present invention overcomes the aforementioned problems and is distinguished over the prior art in general, and these patents in particular by a multifunction clamp and jack system having a generally C-shaped main body with an elongate externally threaded rod having a hexagonal top end portion with a square interior cavity at a top end, and a square interior cavity at a bottom end. The C-shaped main body member may be supported in an upright vertical position by front and rear base support members to allow it to be free standing. The hexagonal top end portion of the threaded rod is configured to receive a conventional open end wrench or a socket of a conventional socket wrench, ratchet wrench or pneumatic wrench, and the square interior cavity at the top and bottom end is configured to receive the male square drive member of a conventional socket wrench, ratchet wrench, pneumatic wrench, or a non-ratcheting breaker bar. The hexagonal top end portion or the square interior cavity may also receive the drive member of an electric or pneumatic wrench. The threaded rod also has a hole extending transversely therethrough disposed beneath the hexagonal top end portion which may receive a removable handle for rotating the threaded rod manually.

The bottom end of the threaded rod has a square interior cavity for receiving selected workpiece engaging attachments and for receiving the male square drive member of a conventional ratchet wrench, or drive member of an electric or pneumatic wrench. The threaded rod may be raised or lowered relative to the main body member by rotating it in a clockwise or counterclockwise direction. Thus, the threaded rod may be lowered to engage and hold a workpiece or press two workpieces together or may be raised to lift or jack up an object or workpiece supported at the top end of the threaded rod.

A plurality of interchangeable workpiece engaging rotary attachments are provided that may be removably installed in the square interior cavity at the bottom end or the top end of the threaded rod for clamping and holding workpieces of various configurations together or jacking them up.

One of the significant features and advantages of the present invention is that the elongate threaded rod member may be rotated by a conventional open end wrench, a conventional socket or ratchet wrench, a non-ratcheting breaker bar, or an electric or pneumatic wrench connected to its top end or bottom end.

Another feature and advantage of the present clamping and jacking system is that a plurality of interchangeable workpiece engaging rotary attachments may be removably installed in the square interior cavity at the bottom end or the top end of the threaded rod for clamping, holding, or lifting a wide variety of variously shaped workpieces or objects.

Another feature and advantage of the present clamping and jacking system is that the C-shaped main body member may be supported in an upright vertical position by front and rear base support members to allow it to be free standing.

Other significant features and advantages of the present invention will become apparent from time to time throughout the specification and claims as hereinafter related.

DETAILED DESCRIPTION OF THE INVENTION

Figure 1:
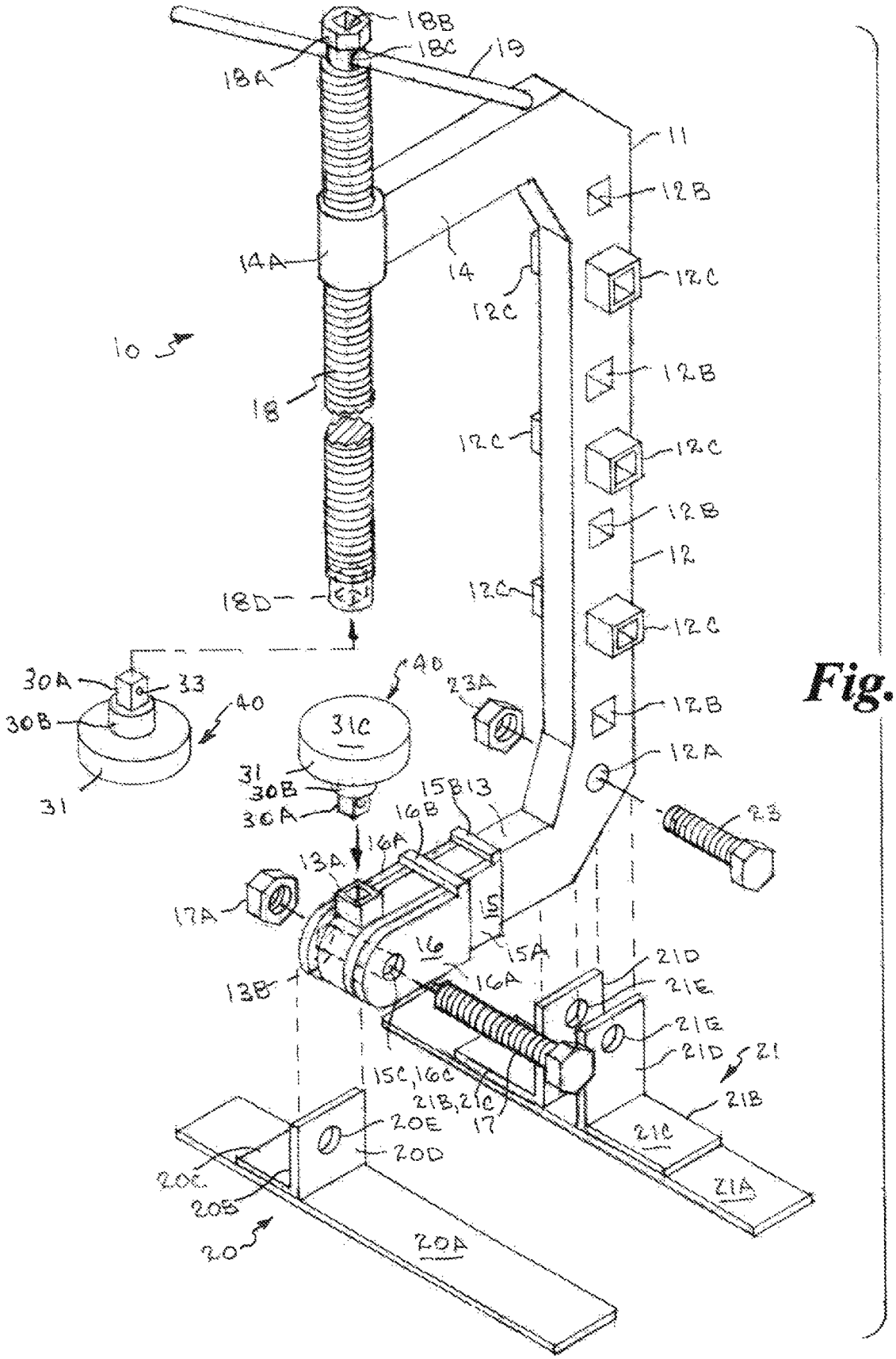
FIG. 1 is an exploded perspective view of the main body of the multifunction clamp and jack system in accordance with the present invention shown positioned above a front and rear support member.
Figure 3:
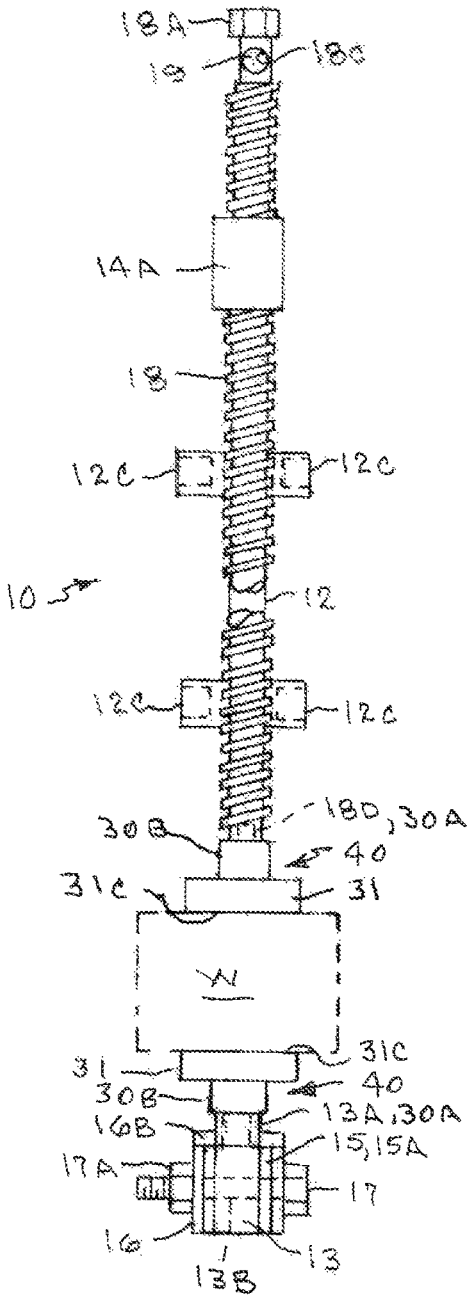
FIG. 3 is a front elevation view of the main body of the multifunction clamp and jack system.
Figure 2:
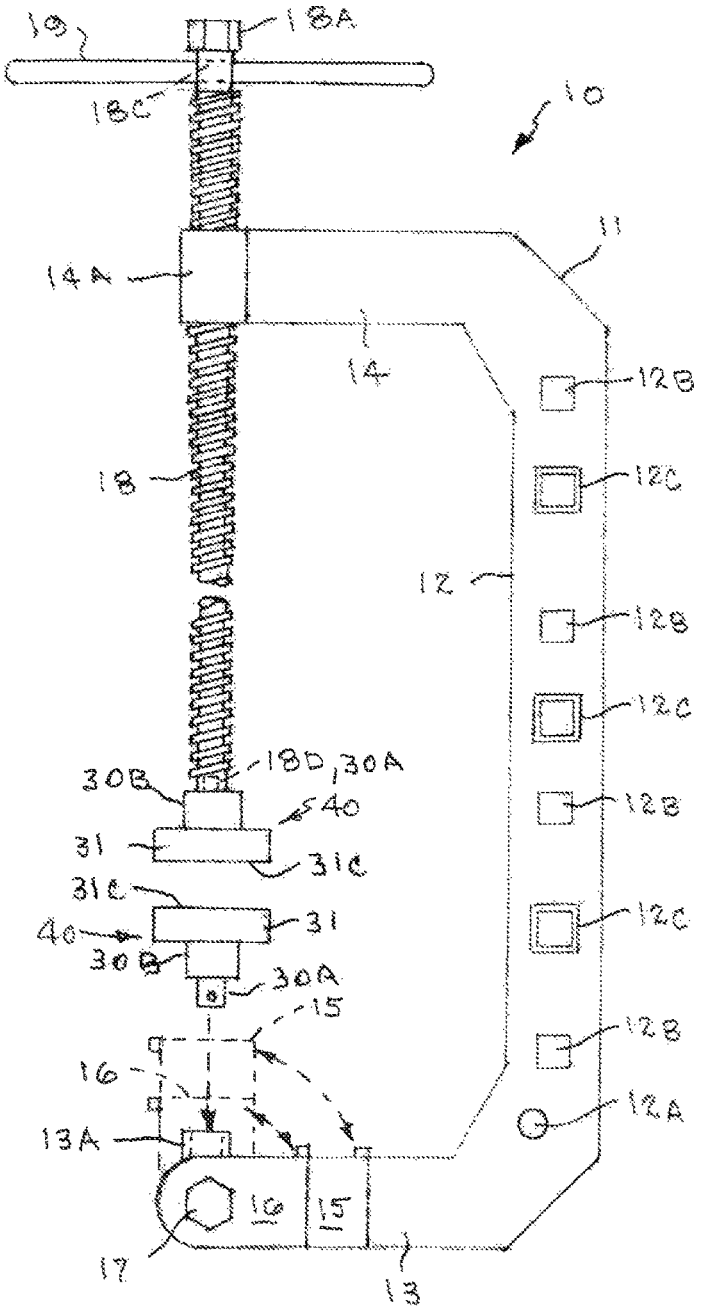
FIG. 2 is a side elevation view of the main body of the multifunction clamp and jack system.

As used herein, the terms "top", "bottom", "front", "rear", "vertical", and "horizontal", refer to the relative direction and orientation of the components as they are shown in the drawings. Referring to the drawings by numerals of reference, there is shown in FIGS. 1-3, a multifunction clamp and jack system 10 in accordance with a preferred embodiment of the invention. The clamp and jack system 10 includes an elongated C-shaped main body member 11 having an elongated first or vertical leg vertical leg 12, a second or bottom leg 13 extending perpendicularly outward from a bottom end thereof, and a third or top leg 14 extending perpendicularly outward from a top end thereof in the same plane as the bottom leg. A hole 12A extends transversely through the vertical leg 12 of the main body member 11 near its intersection with the bottom leg 13. The vertical leg 12 of the C-shaped main body member 11 may be provided with a series of vertically spaced apart square apertures 12B extending transversely therethrough, and square sockets 12C extending a short distance horizontally outward from opposed sides for receiving and storing selected attachments (described hereinafter) when not in use. The top surface of the bottom leg 13 has a square tubular socket 13A extending a short distance vertically upward therefrom for receiving selected attachments. An internally threaded tubular member 14A is secured to the outer end of the top leg 14 of the C-shaped main body member 11 with its vertical axis aligned with the square tubular socket 13A of the bottom leg 13.

A hole 13B extends transversely through the bottom leg 13 of the main body member 11 near its outer end. A first or longer workpiece support member 15 and a shorter workpiece support member 16 are each pivotally mounted at one end of the front portion of the bottom leg 13. The first or longer workpiece support member 15 is formed of a pair of flat generally rectangular legs 15A joined together in laterally spaced apart parallel relation by a rectangular cross member 15B that extends transversely across the top surface of the legs near their back ends and across the top surface of the bottom leg 13 of the main body member 11. The laterally spaced legs 15A slidably straddle the bottom leg 13 of the main body member 11 and each of the legs 15A is provided with a transverse hole 15C near its front end in axial alignment with the hole 13B through the bottom leg 13.

The second or shorter workpiece support member 16 is formed of a pair of flat generally rectangular legs 16A joined together in laterally spaced apart parallel relation by a rectangular cross member 16B that extends transversely across the top surface of the legs near their back ends and across the top surface of the bottom leg 13 of the main body member 11. The laterally spaced legs 16A slidably straddle the legs 15 of the longer workpiece support member 15 and the cross member 16B extend across the top of the bottom leg 13 of the main body member 11. Each of the legs 16A is provided with a transverse hole 16C near its front end in axial alignment with the holes 15C in the longer workpiece support member 15 and the hole 13B through the bottom leg 13 of the main body member 11.

The legs 15A and 16A of the workpiece support members 15 and 16 are pivotally mounted near the outer end of the bottom leg 13 of the main body member 11 by passing a bolt 17 through the aligned holes 15C and 16C of the legs and 13B of the bottom leg 13 of the main body member 11 and securing it with a nut 17A. As shown in FIG. 2, either of the workpiece support members 15 or 16 may be selectively pivoted between a lowered horizontal position parallel to the bottom leg 13 of the main body member 11 and a raised vertical position (shown in dashed line) by loosening the nut 17A and then secured in position by tightening the nut to receive and support workpieces of various sizes and configurations. For example, the shorter workpiece support member 15 may be raised when necessary to clamp an irregular shallow surface such as an angle or channel iron structure having a confined surface area that is difficult to clamp. The longer workpiece support member 16 may be raised when necessary to clamp an irregular deeper surface such as a channel iron structure that has a confined surface area that is difficult to clamp. It should also be understood that either or both of the workpiece support members 15 and 16 may be removed if not needed.

An elongate externally threaded rod 18 is threadely engaged in the internally threaded tubular member 14A at the outer end of the top leg 14 of the C-shaped main body member 11 to rotate relative thereto between a raised position and a lowered position. As best seen in FIG. 1, the threaded rod 18 has a hexagonal top end portion 18A with a square interior cavity 18B. The hexagonal top end portion 18A exterior is configured to receive a conventional open end wrench or a socket of a conventional socket wrench, ratchet wrench, electric or pneumatic wrench, and the square interior cavity 18B is configured to receive the male square drive member of a conventional ratchet wrench or a non-ratcheting breaker bar. The hexagonal top end portion 18A or the square interior cavity 18B may also receive the drive member of an electric or pneumatic wrench. The threaded rod 18 also has a hole 18C extending transversely therethrough disposed beneath the hexagonal top end portion 18A which may receive a removable handle 19 for rotating the threaded rod manually. The handle 19 may be removed when using a ratchet or impact wrench to rotate the threaded rod.

The bottom end of the threaded rod 18 has a square interior cavity 18D for receiving selected attachments (described hereinafter) or for receiving the male square drive member of a conventional ratchet wrench or electric or pneumatic wrench. In FIG. 1, an example of a free spinning flat end rotary attachment 40 (described hereinafter) is shown being attached to the square interior cavity 18D at the bottom end of the threaded rod 18, and a second free spinning flat end rotary attachment 40 being attached to the upstanding square tubular socket 13A of the bottom leg 13 of the main body 11.

The square interior cavities 18B and 18C at the top and bottom ends of the threaded rod 18 can also accommodate additional threaded rods of various lengths having male square ends to extend the length of the threaded rod of the main body member 11.

It should be understood from the foregoing that the threaded rod 18 may be raised or lowered relative to the main body member 11 by rotating it in a clockwise or counterclockwise direction. Thus, the threaded rod 18 may be lowered to engage and hold a workpiece W, as shown in FIG. 3, or to press two workpieces together, or may be raised to lift or jack up an object or workpiece supported at the top end of the threaded rod.

As shown in FIG. 1, the C-shaped main body member 11 may be supported in an upright vertical position by front base support member 20 and rear base support member 21, to allow it to be free standing.

The front base support member 20 is formed of an elongate flat rectangular base plate 20A and an L-shaped support member 20B having a horizontal leg 20C secured to the top surface thereof near one end thereof, such as by welding, and an upstanding vertical leg 20D having a hole 20E extending transversely therethrough. The upstanding vertical leg 20D is removably secured to the one side of the bottom leg 13 of the main body member 11 by aligning its hole 20E with the holes 15C and 16C of the shorter and longer workpiece support members 15 and 16, and hole 13B through the bottom leg 13 of the main body member 11, and passing the bolt 17 through the aligned holes and securing it with the nut 17A. It should also be understood that either or both of the workpiece support members 15 and 16 maybe removed if not needed, wherein the front base support member 20 may be bolted directly onto the bottom leg 13 of the main body member 11.

The rear base support member 21 is secured the rear portion of the of the main body member 11. The rear base support member 21 is formed of an elongate flat rectangular base plate 21A and an pair of L-shaped support members 21B having a horizontal leg 21C secured to the top surface thereof near the center thereof in laterally opposed spaced apart relation, such as by welding, and an upstanding vertical leg 21D having a hole 21E extending transversely therethrough. The upstanding vertical legs 21D straddle the rear portion of the bottom leg 13 and lower portion of the vertical leg 12 of the main body 11, and is removably secured thereto by aligning the holes 21E with the hole 12A extending through the vertical leg 12, and passing a bolt 23 through the aligned holes and securing it with a nut 23A.

It should be understood that the base support members 20 and 21 allow the main body member 11 to be free standing, but may be removed to allow it to be used as a conventional clamp.

Referring now to FIGS. 4-10, there is shown a plurality of interchangeable rotary attachments that may be used for clamping, holding, or lifting a variety of workpieces and objects of various configurations. In the following discussion, similar components are assigned the same numerals of reference but may not be described in detail to avoid repetition. The rotary attachments described hereinafter may be provided in pairs and are configured to be selectively and removably installed in the square interior cavity 18D at the bottom of the threaded rod 18 or installed in the upstanding square tubular socket 13A on the top surface of the bottom leg 13 of the main body 11. Selected attachments may also be installed in the square interior cavity 18B at the top end of the threaded rod.

Figure 4:
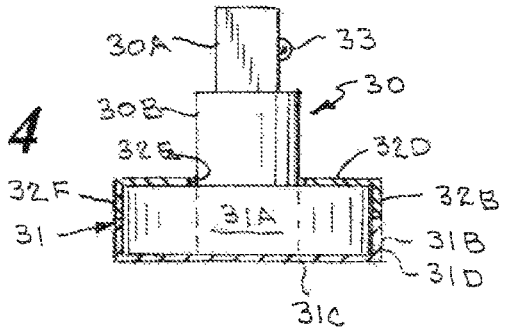
FIG. 4 is longitudinal cross sectional view showing the main components of the rotary attachment members.

As seen in FIG. 4, each rotary attachment has a drive stud member 30 with a square end portion 30A and a cylindrical portion 30B surrounded by a cylindrical rotary member 31 that rotates relative to the drive stud. The cylindrical rotary member 31 is formed of a conventional roller bearing, ball bearing, or thrust bearing 31A (conventional and therefore not shown in detail). One end of the outer ring of the bearing 31A is surrounded by first end cap 31B having a flat end wall 31C and a cylindrical side wall side 31D. The opposed end of the outer ring of the bearing is surrounded by a second end cap 32B having a flat end wall 32D with a central circular aperture 32E and a cylindrical side wall 32F. The end caps 31B and 32B, may be secured to the outer ring of the bearing 31A by press fitting or epoxy other conventional means and form the exterior of the cylindrical rotary member 31 of the attachment. The drive stud 30 having a square end portion 30A and a cylindrical lower portion 30B is secured to the inside diameter of the inner ring of the bearing 31A by securing the cylindrical lower portion to the inside diameter of the inner ring of the bearing 31A by press fitting, epoxy or other conventional means. The square end portion 30A of the drive stud 30 is provided with a ball detent 33 spring mounted in an aperture in the drive stud with the normal position of a portion of the spring biased ball protruding outward from a flat side surface of the drive stud, similar to the drive stud of a ratchet wrench. The ball detent mechanism 33 is of conventional construction and may be formed by installing a small spring and the ball in a small hole in the square end portion 30A and then swedging the material surrounding the hole to make the hole smaller so that the ball cannot come out again.

When the drive stud 30 of a rotary attachment is manually pressed into the square tubular socket 13A on the top surface of the bottom leg 13 of the main body 11 or the square interior cavity 18C or cavity 15B at the bottom or top of the threaded rod 18, the spring loaded ball detent 33 protruding from the exterior surface of the drive stud engages the square interior recess and thereby firmly holds the attachment on the square tubular socket of the bottom leg of the main body, or the end of the elongate threaded rod. To remove the attachment from the bottom leg of the main body or the end of the elongate threaded rod threaded rod, the user may grasp the attachment and pull on it.

Figure 5:
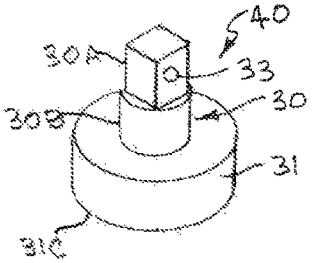
FIG. 5 is a perspective view of a flat end free spinning rotary attachment

FIG. 5 shows a flat end free spinning rotary attachment 40 which has all of the components described above with reference to FIG. 4 and assembled in the same way, but not described again in detail, which may be mounted in the square tubular socket 13A on the top surface of the bottom leg 13 of the main body 11 and/or the square interior cavity 18D at the bottom of the threaded rod 18. In this embodiment, the flat end wall 31C of the rotary attachment end cap 31B of the attachment 40 is engaged on a workpiece and the cylindrical rotary member 31 of the free spinning rotary attachment prevents the C-shaped main body member 11 (described previously) from "walking" or moving around relative to the workpiece while turning the elongate threaded rod 18 (described previously). The flat bottom free spinning rotary attachment 40 may also be installed in the square interior cavity 18B at the top end of the threaded rod 18, for engaging a workpiece or object to be raised or lifted.

Figure 6:
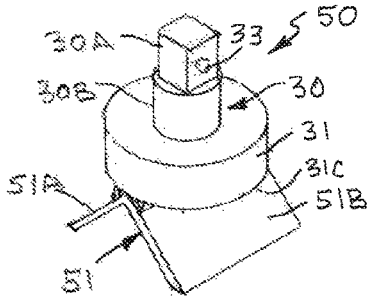
FIG. 6 is a perspective view of an open angle rotary attachment.

FIG. 6 shows an open angle rotary attachment 50 which has all of the components described above with reference to FIG. 4 and assembled in the same way, but not described again in detail, which may be mounted in the square tubular socket 13A on the top surface of the bottom leg 13 of the main body 11 and/or the square interior cavity 18D at the bottom of the threaded rod 18. In this embodiment, an inverted V-shaped member 51 with outwardly diverging rectangular legs 51A and 51B adapted to engage a workpiece is secured, such as by welding, to the flat end wall 31C of the rotary attachment end cap 31B to extend diametrically across the flat wall end wall. It should be understood that the V-shaped member 51 may extend a distance horizontally outward beyond the circumference of the cylindrical rotary member 31. The rotary member 31 prevents the workpiece straddled by the rectangular legs 51A and 51B from rotating or moving around while turning the elongate threaded rod 18. The open angle rotary attachment 50 may also be installed in the square interior cavity 18B at the top end of the threaded rod 18 for engaging a workpiece or object to be raised or lifted.

Figure 7:
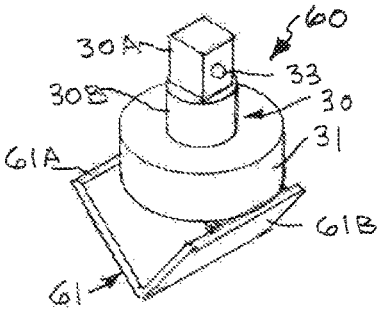
FIG. 7 is a perspective view of a closed angle rotary attachment.

FIG. 7 shows a closed angle V-shaped rotary attachment 60 which has all of the components described above with reference to FIG. 4 and assembled in the same way, but not described again in detail, which may be mounted in the square tubular socket 13A on the top surface of the bottom leg 13 of the main body 11 and/or the square interior cavity 18D at the bottom of the threaded rod 18. In this embodiment, a V-shaped member 61 with diverging rectangular legs 61A and 61B adapted to engage a workpiece is secured such as by welding the diverging legs to diametrically opposed sides of the to the flat end wall 31C of the rotary attachment end cap 31B. It should be understood that the V-shaped member 61 may extend a distance horizontally outward beyond the circumference of the cylindrical rotary member 31. The rotary member 31 prevents the workpiece engaged by the diverging rectangular legs 61A and 61B from rotating or moving around while turning the elongate threaded rod 18. The closed angle rotary attachment 60 may also be installed in the square interior cavity 18B at the top end of the threaded rod 18 for engaging a workpiece or object to be raised or lifted.

Figure 8:
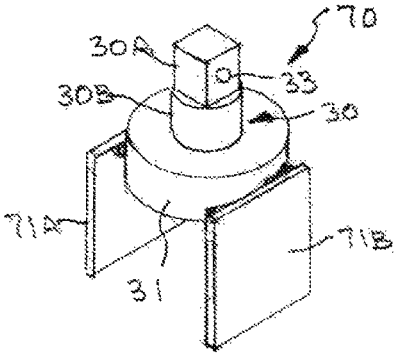
FIG. 8 is a perspective view of a straddle rotary attachment.

FIG. 8 shows a straddle rotary attachment 70 which has all of the components described above with reference to FIG. 4 and assembled in the same way, but not described again in detail, which may be mounted in the square tubular socket 13A on the top surface of the bottom leg 13 of the main body 11 and/or the square interior cavity 18D at the bottom of the threaded rod 18. The straddle rotary attachment 70 has a pair of rectangular straps or ears 71A and 71B, welded at an upper end to diametrically opposed sides of the cylindrical side wall of the flat wall end cap 31B. The opposed rectangular straps or ears 71A and 71B extend downwardly from opposed sides of the rotary member 31 to straddle a workpiece. It should be understood that the rectangular straps or ears 71A and 71B may extend a distance horizontally outward beyond the circumference of the cylindrical rotary member 31. The rotary member 31 prevents the workpiece straddled by rectangular straps or ears 71A and 71B from rotating or moving around while turning the elongate threaded rod 18 (described previously). The straddle rotary attachment 70 may also be installed in the square interior cavity 18B at the top end of the threaded rod 18 for engaging a workpiece or object to be raised or lifted.

Figure 9:
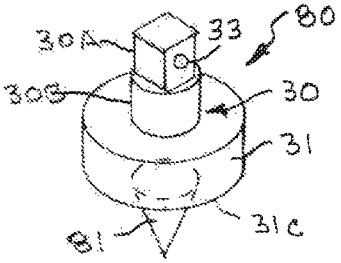
FIG. 9 is a perspective view of a pointed rotary attachment.

FIG. 9 shows a pointed rotary attachment 80 which has all of the components described above with reference to FIG. 4 and assembled in the same way, but not described again in detail, which may be mounted in the square tubular socket 13A on the top surface of the bottom leg 13 of the main body 11 and/or the square interior cavity 18D at the bottom of the threaded rod 18. The pointed rotary attachment 80 has a V-shaped conical member 81 welded at its base to the flat end wall 31C of the rotary attachment end cap 31B with its pointed bottom end extending therefrom to engage a workpiece. The rotary member 31 prevents the pointed bottom end of the conical member 81 from "walking" or moving around relative to the workpiece while turning the elongate threaded rod 18 (described previously). The pointed rotary attachment 80 may also be installed in the square interior cavity 18B at the top end of the threaded rod 18 for engaging a workpiece or object to be raised or lifted.

Figure 10:
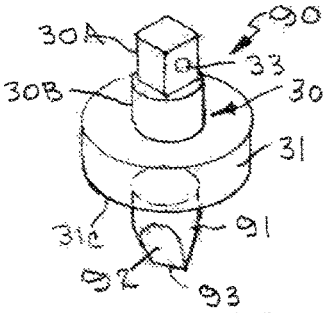
FIG. 10 is a perspective view of a chisel point rotary attachment.

FIG. 10 shows a chisel point rotary attachment 90 which has all of the components described above with reference to FIG. 4 and assembled in the same way, but not described again in detail, which may be mounted in the square tubular socket 13A on the top surface of the bottom leg 13 of the main body 11 and/or the square interior cavity 18D at the bottom of the threaded rod 18. The chisel point attachment 90 has a chisel pointed member 91 with converging V-shaped flat sides 92 welded at a top end to the flat end wall 31C of the attachment end cap 31B that terminate in a beveled cutting edge 93 at the bottom end to engage a workpiece. The rotary member 31 prevents the beveled cutting edge 93 from "walking" or moving around relative to the workpiece while turning the elongate threaded rod 18 (described previously). The chisel point rotary attachment 90 may also be installed in the square interior cavity 18B at the top end of the threaded rod for engaging a workpiece or object to be raised or lifted.

Figure 11:
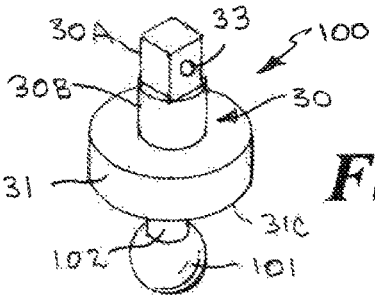
FIG. 11 is a perspective view of a ball rotary attachment.

FIG. 11 shows a ball rotary attachment 100 which has all of the components described above with reference to FIG. 4 and assembled in the same way, but not described again in detail, which may be mounted in the square tubular socket 13A on the top surface of the bottom leg 13 of the main body 11 and/or the square interior cavity 18D at the bottom of the threaded rod 18. The ball rotary attachment 100 has a spherical ball member 101 with a neck portion 102 welded to the flat end wall 31C of the end cap 31B that extends therefrom to engage a workpiece. The rotary member 31 prevents the workpiece engaged by the spherical ball member 101 from rotating or moving around while turning the elongate threaded rod 18. The ball rotary attachment 100 may also be installed in the square interior cavity 18B at the top end of the threaded rod for engaging a workpiece or object to be raised or lifted.

When not in use, the above described of interchangeable rotary attachments may be stored on the vertical leg 12 of the C-shaped main body member 11 by pressing the square end portion 30A of the drive studs 30 of the attachments into selected ones of the vertically spaced apart square apertures 11E or square sockets 11F on the sides of the vertical leg.

While the present invention has been disclosed in various preferred forms, the specific embodiments thereof as disclosed and illustrated herein are considered as illustrative only of the principles of the invention and are not to be considered in a limiting sense in interpreting the claims. The claims are intended to include all novel and non-obvious combinations and sub-combinations of the various elements, features, functions, and/or properties disclosed herein. Variations in size, materials, shape, form, function and manner of operation, assembly and use, are deemed readily apparent and obvious to one skilled in the art from this disclosure, and all equivalent relationships to those illustrated in the drawings and described in the specification are intended to be encompassed in the following claims defining the present invention.

The invention claimed is:

1. A multifunction clamp and jack system for clamping, holding, or lifting variously shaped workpieces, comprising:

a generally C-shaped main body having an elongated first leg, a second leg extending perpendicularly outward from one end thereof with a square tubular socket adjacent extending a short distance upward therefrom for removably receiving selected workpiece engaging attachments, and a third leg extending perpendicularly outward from an opposed end in the same plane as said first leg with an internally threaded tubular member secured to the outer end thereof having a central axis aligned with said square tubular socket of said second leg;

an elongate externally threaded rod threadely engaged in said internally threaded tubular member to rotate relative thereto between a raised position and a lowered position, said threaded rod having a hexagonal top end portion with a square interior cavity, and a square interior cavity at a bottom end of said threaded rod, said hexagonal top end portion adapted to receive to receive an open end wrench, a socket member of a socket wrench, ratchet wrench, electric wrench, or pneumatic wrench, and said square interior cavity of said hexagonal top end portion and said square interior cavity at said bottom end of said threaded rod adapted to receive to receive a male square drive member of a socket wrench, ratchet wrench, electric wrench, pneumatic wrench, or non-ratcheting breaker bar, for rotating said threaded rod; and a plurality of interchangeable workpiece engaging rotary attachments, each having a drive stud member with a square end portion having a spring biased ball detent protruding from a flat surface thereof, and a cylindrical rotary portion that rotates relative to said drive stud having a workpiece engaging component configured to engage a workpiece;

said square end portion of said drive stud member configured to be selectively and removably engaged in said square tubular socket of said main body second leg, said square interior cavity of said hexagonal top end portion of said threaded rod, or said square interior cavity at said bottom end of said threaded rod.

2. The multifunction clamp and jack system according to claim 1, further comprising:

a front base support member releasably connected adjacent to a front end of said second leg and a rear base support member releasably connected adjacent to a back end of said second leg configured to support said C-shaped main body member in a free standing upright vertical position.

3. The multifunction clamp and jack system according to claim 1, further comprising:

a hole extending transversely through said threaded rod beneath said hexagonal top portion; and a rod-shaped handle slidably and removably received in said hole for manually rotating said threaded rod.

4. The multifunction clamp and jack system according to claim 1, further comprising:

a workpiece support member having a pair of flat rectangular legs joined together in laterally spaced apart parallel relation slidably received on lateral sides of said second leg and removably and pivotally connected adjacent to a front end thereof;

said workpiece support member being selectively pivoted between a lowered horizontal position with said legs generally parallel to and straddling said second leg said second leg and a raised vertical position with outer ends of said legs facing said bottom end of said threaded rod to receive and support workpieces of various sizes and configurations.

5. The multifunction clamp and jack system according to claim 1, further comprising:

a series of spaced apart square apertures extending transversely through said elongated first leg of said main body, and a series of square sockets extending a short distance outward from opposed sides of said elongated first leg configured to receive said square end portion of said drive stud member of respective said workpiece engaging rotary attachments for storing them when not in use.

6. The multifunction clamp and jack system according to claim 1, wherein said cylindrical rotary portion member of each said workpiece engaging rotary attachment is formed of a bearing selected from the group consisting of a roller bearing, ball bearing, and thrust bearing, and the end opposite said square end portion of said drive stud is surrounded by an end cap having a cylindrical peripheral side wall and a flat end wall.

7. The multifunction clamp and jack system according to claim 6, wherein said workpiece engaging rotary attachments are selected from the group consisting of:

a flat end free spinning rotary attachment wherein said workpiece engaging component is said flat end wall of said end cap;

an open angle rotary attachment wherein said workpiece engaging component is an inverted V-shaped member secured at its apex to said flat end wall of said end cap and having outwardly diverging rectangular legs configured to engage a workpiece;

a closed angle rotary attachment wherein said workpiece engaging component is a V-shaped member having outwardly diverging rectangular legs secured to said end cap side wall configured to engage a workpiece;

a straddle rotary attachment wherein said workpiece engaging component is a pair of rectangular straps secured at upper end to diametrically opposed sides of said cylindrical side wall of said end cap and extending from opposed sides thereof configured to straddle a workpiece;

a pointed rotary attachment wherein said workpiece engaging component is a V-shaped conical member secured at its base to said flat end wall of said end cap with its pointed end extending therefrom configured to engage a workpiece;

a chisel point rotary attachment wherein said workpiece engaging component is a chisel pointed member secured to said flat end wall of said end cap with converging V-shaped flat sides extending therefrom defining a beveled cutting edge configured to engage a workpiece; and a ball rotary attachment wherein said workpiece engaging component is a spherical ball member with a neck portion secured to said flat end wall of said end cap such that said spherical ball is configured to engage a workpiece.

* * * * *